US008137221B2

(12) United States Patent
Ashino

(10) Patent No.: US 8,137,221 B2
(45) Date of Patent: Mar. 20, 2012

(54) RACKET FRAME

(75) Inventor: Takeshi Ashino, Kobe (JP)

(73) Assignee: SRI Sports Limited, Kobe-Shi (JP)

( * ) Notice: Subject to any disclaimer, the term of this patent is extended or adjusted under 35 U.S.C. 154(b) by 131 days.

(21) Appl. No.: 12/790,604

(22) Filed: May 28, 2010

(65) Prior Publication Data

US 2011/0009216 A1 Jan. 13, 2011

(30) Foreign Application Priority Data

Jul. 10, 2009 (JP) ..... 2009-163629

(51) Int. Cl.
*A63B 49/02* (2006.01)
*A63B 49/01* (2006.01)

(52) U.S. Cl. ..... 473/535; 473/537

(58) Field of Classification Search ..... 473/524, 473/535–537
See application file for complete search history.

(56) References Cited

U.S. PATENT DOCUMENTS

| | | | | |
|---|---|---|---|---|
| 4,983,242 | A * | 1/1991 | Reed | 156/172 |
| 5,314,180 | A * | 5/1994 | Yamagishi et al. | 473/521 |
| 5,507,486 | A * | 4/1996 | Miyamoto | 473/535 |
| 5,538,243 | A * | 7/1996 | Yamamoto et al. | 473/537 |
| 6,663,514 | B2 * | 12/2003 | Niwa et al. | 473/521 |
| 6,688,997 | B2 * | 2/2004 | Ashino et al. | 473/535 |
| 7,012,111 | B2 * | 3/2006 | Kanemitsu et al. | 524/406 |
| 7,059,981 | B2 * | 6/2006 | Ashino et al. | 473/535 |
| 7,131,920 | B2 * | 11/2006 | Ashino | 473/535 |
| 7,137,912 | B2 * | 11/2006 | Ashino et al. | 473/537 |
| 7,217,203 | B2 * | 5/2007 | Takeuchi et al. | 473/537 |
| 2003/0064838 | A1 * | 4/2003 | Ashino et al. | 473/535 |
| 2005/0119075 | A1 * | 6/2005 | Ashino | 473/535 |
| 2005/0192128 | A1 * | 9/2005 | Takeuchi et al. | 473/520 |
| 2011/0009216 | A1 * | 1/2011 | Ashino | 473/535 |

FOREIGN PATENT DOCUMENTS

| | | | |
|---|---|---|---|
| JP | 02261479 | A * | 10/1990 |
| JP | 05015617 | A * | 1/1993 |
| JP | 07194742 | A * | 8/1995 |
| JP | 11009724 | A * | 1/1999 |
| JP | 2000325503 | A * | 11/2000 |
| JP | 3401163 | B2 | 4/2003 |
| JP | 2004159868 | A * | 6/2004 |
| JP | 2005058368 | A * | 3/2005 |
| JP | 3738276 | B2 | 1/2006 |
| JP | 4213947 | B2 | 1/2009 |
| JP | 4252397 | B2 | 4/2009 |
| JP | 4253072 | B2 | 4/2009 |
| JP | 2011015885 | A * | 1/2011 |

* cited by examiner

*Primary Examiner* — Raleigh W. Chiu
(74) *Attorney, Agent, or Firm* — Birch, Stewart, Kolasch & Birch, LLP

(57) ABSTRACT

A racket frame 10 of the present invention includes fiber reinforced resinous layers. At least one of the fiber reinforced resinous layers is a layer (L1) in which a rubber component is blended. A matrix of the layer (L1) contains a rubber component. When a total weight of a matrix contained in the racket frame 10 is defined as Wm (g) and a total weight of the rubber component contained in the frame 10 is defined as Wg (g), a rate Rg (%) of the total weight Wg to the total weight Wm is 2.5(%) or greater and 17.5(%) or less. In this frame 10, a ratio [Rh/Rs] of plane rigidity Rh to throat rigidity Rs is 0.05 or greater and 0.2 or less. Preferably, the plane rigidity Rh is 30 (kgf/cm) or greater and 70 (kgf/cm) or less. Preferably, the throat rigidity Rs is 250 (kgf/cm) or greater and 800 (kgf/cm) or less.

20 Claims, 6 Drawing Sheets

RACKET FRAME

This application claims priority on Patent Application No. 2009-163629 filed in JAPAN on Jul. 10, 2009, the entire contents of which are hereby incorporated by reference.

BACKGROUND OF THE INVENTION

1. Field of the Invention

The present invention relates to a racket frame.

2. Description of the Related Art

A racket frame using FRP (fiber reinforced plastic) is known. The fiber reinforced plastic has a fiber and a matrix. The matrix is usually a resin.

Racket frames in which a rubber component is blended in the matrix are disclosed. This rubber component can enhance vibration absorbing performance.

In a racket frame described in Japanese Patent Application Publication (JP-B) No. 3401163, a matrix resin contains (meth) acrylic polymeric fine particles. The (meth)acrylic polymeric fine particles contain a rubber-like polymeric component. The (meth)acrylic polymeric particles are mixed with an epoxy resin.

JP-B No. 4213947 and JP-B No. 4252397 disclose a racket frame in which liquid rubber is blended in the matrix resin. In the racket frame of JP-B No. 4213947, the matrix resin contains rubber modified epoxy having a sea-island structure of an epoxy resin and the liquid rubber. In JP-B No. 4252397, the matrix resin contains a mixture of rubber modified epoxy and an epoxy resin containing no rubber component. The rubber modified epoxy is obtained by previously mixing and reacting the liquid rubber with the epoxy resin.

JP-B No. 3738276 discloses a racket frame having an ultra-light weight and having excellent resilience and hitting feeling. JP-B No. 3738276 regulates a frame weight, balance, (top pressure rigidity/ball-hitting face rigidity), and (ball-hitting face rigidity/throat part rigidity) or the like.

JP-B No. 4253072 discloses a racket frame tending to be treated and having excellent resilience performance. JP-B No. 4253072 regulates a product of a weight and balance, an in-plane direction rigidity value Gh in side parts of a head part, an out-of-plane direction rigidity value Gs in throat parts, a ratio (Gh/Gs), a frame weight, and balance or the like.

SUMMARY OF THE INVENTION

The rubber component may bring about reduction in strength and reduction in uniformity of products. The techniques of the references can suppress these problems. However, the blending of the rubber component tends to reduce the strength. Higher strength is preferable.

When the rate of the rubber component is suppressed, the strength can be enhanced. However, in this case, the vibration absorbing performance is apt to be reduced to reduce the hitting feeling. The low vibration absorbing performance may cause a tennis elbow.

The present inventors examined a technique for enhancing strength and hitting feeling while having a rubber component. The present invention was accomplished based on this examination.

It is an object of the present invention to provide a racket frame which can have excellent strength and hitting feeling.

A racket frame according to the present invention includes fiber reinforced resinous layers. At least one of the fiber reinforced resinous layers is a layer (L1) containing a rubber component. When a total weight of a matrix in the whole racket frame is defined as Wm (g) and a total weight of the rubber component in the whole racket frame is defined as Wg (g), a rate Rg (%) of the weight Wg to the weight Wm is 2.5(%) or greater and 17.5(%) or less. A ratio [Rh/Rs] of plane rigidity Rh (kgf/cm) to throat rigidity Rs (kgf/cm) is 0.05 or greater and 0.2 or less.

Preferably, the plane rigidity Rh is 30 (kgf/cm) or greater and 70 (kgf/cm) or less. Preferably, the throat rigidity Rs is 250 (kgf/cm) or greater and 800 (kgf/cm) or less.

Preferably, the layer (L1) containing the rubber component and a layer (L2) containing no rubber component are used in combination as the fiber reinforced resinous layers.

Preferably, the rubber component is a core shell polymer. Preferably, this core shell polymer is dispersed in the state of primary particles in a matrix of the layer (L1).

DESCRIPTION OF THE PREFERRED EMBODIMENTS

The present invention will be described below in detail based on preferred embodiments with reference to the drawings.

Figure 1:
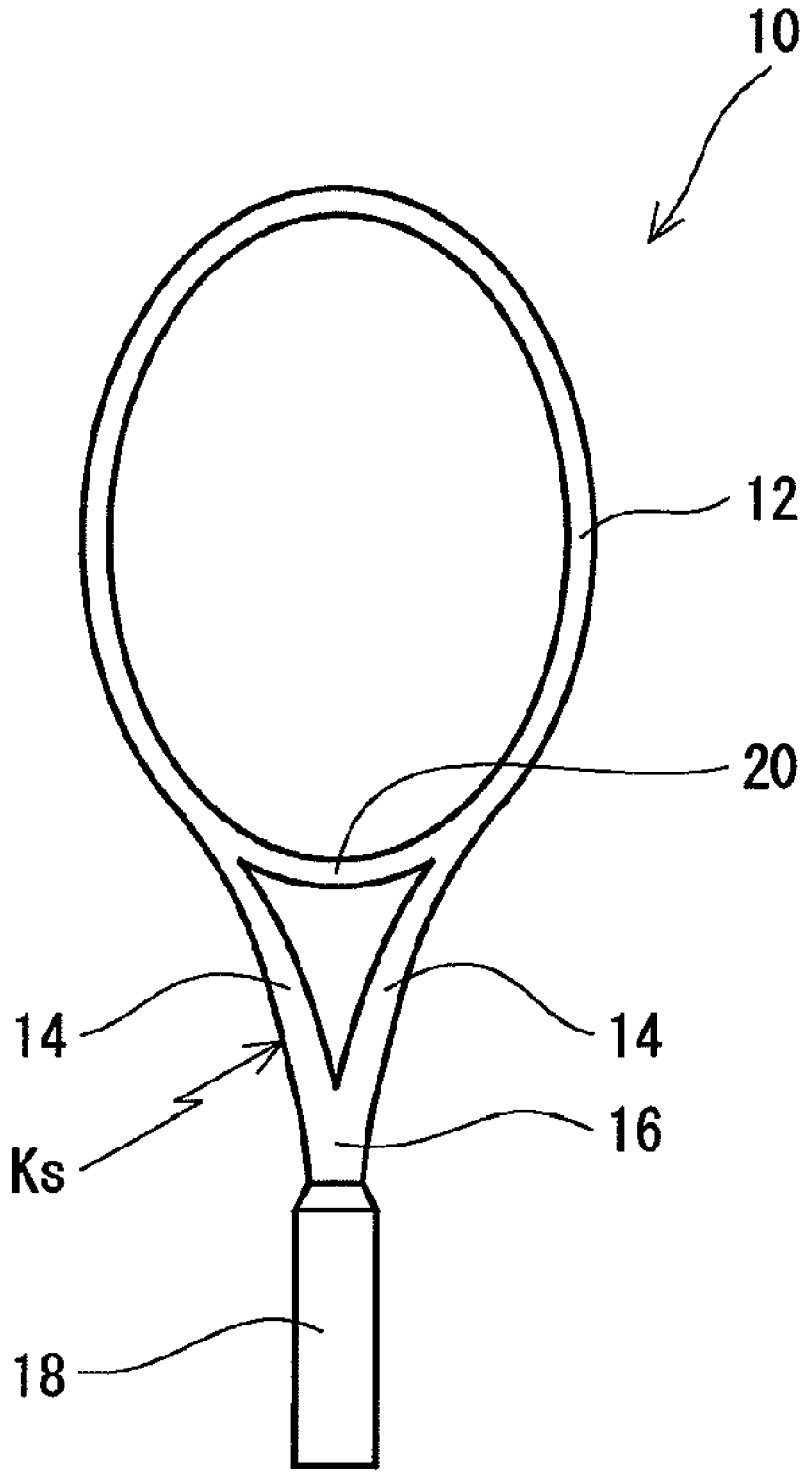
FIG. 1 is a front view of a racket frame according to one embodiment of the present invention.

As shown in FIG. 1, this racket frame 10 is provided with a head part 12, two throat parts 14, a shaft part 16, and a grip part 18. The head part 12 forms the contour of a ball-hitting face. The head part 12 has an approximately elliptical cross-sectional shape.

One ends of the two throat parts 14 extend from the head part 12. The other ends of the two throat parts 14 are mutually merged. The shaft part 16 extends from a place where the throat parts 14 are merged. The shaft part 16 is continuously and integrally formed with the throat parts 14. The grip part 18 is continuously and integrally formed with the shaft part 16. A portion of the head part 12 sandwiched by the throat parts 14 is a yoke part 20.

This racket frame is composed of a formed body provided with fiber reinforced resinous layers. A matrix resin of the fiber reinforced resinous layer is an epoxy resin. A reinforced fiber of the fiber reinforced resinous layer is a carbon fiber. The racket frame 10 has a cavity therein. More specifically, the racket frame 10 is hollow. Strings are stretched in this racket frame 10, and a grip tape and an end cap or the like are mounted to the racket frame 10 to produce a hard tennis racket.

At least one of the fiber reinforced resinous layers is a layer (L1) in which a rubber component is blended. This layer (L1) in which the rubber component is blended has a reinforced fiber and a matrix. The typical reinforced fiber is a carbon fiber. This matrix is an epoxy resin composition. The matrix contains an epoxy resin and a rubber component.

Rubber of the rubber component is not limited. In respect of vibration absorbing performance, crosslinked rubber is preferable. A molecule of this rubber may be a homopolymer, or a copolymer. This rubber may be diene rubber or non-diene rubber. Examples of the diene rubber include natural rubber, isoprene rubber, butadiene rubber, styrene-butadiene rubber, chloroprene rubber, acrylonitrile-butadiene rubber, and norbornene rubber. Examples of the non-diene rubber include butyl rubber, ethylene-propylene rubber, ethylene-propylene diene rubber, urethane rubber, silicone rubber, and acrylic rubber. Another examples of the rubber include a thermoplastic elastomer. The preferable thermoplastic elastomer has a hard segment and a soft segment. Examples of the thermoplastic elastomer include a polystyrene thermoplastic elastomer, a polyolefin thermoplastic elastomer, a polyurethane thermoplastic elastomer, a polyester thermoplastic elastomer, and a polyamide thermoplastic elastomer.

Preferably, this rubber component exists in the form of particles in the matrix. Preferably, the rubber component is dispersed in the form of particles.

In the present application, a total weight of the matrix in all the fiber reinforced resinous layers is defined as Wm (g), and a weight of the rubber component in all the fiber reinforced resinous layers is defined as Wg (g). The total weight Wm is a total weight of the matrix in the whole racket frame. The weight Wg is a total weight of the rubber component in the whole racket frame.

In respect of hitting feeling, a rate Rg (%) of the weight Wg to the total weight Wm is equal to or greater than 2.5(%), more preferably equal to or greater than 4(%), and still more preferably equal to or greater than 6(%). This rate Rg (%) can be calculated by the following equation.

$$Rg=(Wg/Wm)\times 100$$

In respect of strength, the rate Rg (%) is preferably equal to or less than 17.5(%), more preferably equal to or less than 15(%), and still more preferably equal to or less than 12.5(%).

The rubber component contained in the racket frame may reduce the strength of the racket frame. A position on which stress is apt to converge in hitting a ball is a throat part. The excessive deformation of the throat part may generate cracks starting from the rubber component, in the throat part. In respect of enhancing the frame strength while having the rubber component, it is effective to enhance throat rigidity Rs.

On the other hand, when the throat rigidity Rs is excessively high, the hitting feeling is apt to be deteriorated. Particularly, when the throat rigidity Rs is excessively high, bite sensation is hard to obtain. The "bite sensation" is known as an index indicating good hitting feeling. The deterioration of the hitting feeling caused by the high throat rigidity Rs can be suppressed (alleviated) by reducing plane rigidity Rh. More specifically, the plane rigidity Rh is set slightly lower, and the throat rigidity Rs is set slightly higher. Thereby, the frame strength can be enhanced under the presence of the rubber component, and the hitting feeling can be enhanced. In these respects, a ratio [Rh/Rs] is preferably equal to or less than 0.2, and more preferably equal to or less than 0.15. When the ratio [Rh/Rs] is excessively small, a difference between the rigidity of the throat part and that of the other portion becomes excessive to change the balance of the deformation of the racket frame. This change of the balance may cause the deterioration of the hitting feeling. In this respect, the ratio [Rh/Rs] is preferably equal or greater than 0.05, and more preferably equal or greater than 0.1.

The plane rigidity Rh is not limited. When the plane rigidity Rh is excessively low, the frame strength is apt to be reduced. In this respect, the plane rigidity Rh is preferably equal to or greater than 30 (kgf/cm), more preferably equal to or greater than 40 (kgf/cm), and still more preferably equal to or greater than 45 (kgf/cm). When the plane rigidity Rh is excessively great, resilience performance is excessively great. Thereby, a ball does not fall in a court, and a probability of the out of the ball is apt to be high. More specifically, when the plane rigidity Rh is excessively great, control performance is apt to be reduced. As described above, when the ratio [Rh/Rs] is small, the hitting feeling tends to be enhanced. In these respects, the plane rigidity Rh is preferably equal to or less than 70 (kgf/cm), more preferably equal to or less than 60 (kgf/cm), and still more preferably equal to or less than 55 (kgf/cm).

The throat rigidity Rs is not limited. In view of suppressing the deformation of the throat part to enhance the frame strength, the throat rigidity Rs is preferably equal to or greater than 250 (kgf/cm), more preferably equal to or greater than 290 (kgf/cm), and still more preferably equal to or greater than 350 (kgf/cm). In respects of suppressing a frame weight and of the hitting feeling, the throat rigidity Rs is preferably equal to or less than 800 (kgf/cm), and more preferably equal to or less than 600 (kgf/cm).

In order to reduce the plane rigidity Rh, the following constitutions can be employed.

- The thickness of the whole frame is reduced.
- The elastic modulus of a fiber used for the whole frame is lowered.
- The weight rate of the fiber in the whole frame is reduced, and the weight rate of a resin is increased.

In order to increase the plane rigidity Rh, the following constitutions can be employed.

- The thickness of the whole frame is increased.
- The elastic modulus of the fiber used for the whole frame is increased.
- The weight rate of the fiber in the whole frame is increased, and the weight rate of the resin is reduced.

In order to reduce the throat rigidity Rs, the following constitutions can be employed.

- The thickness of the throat part is reduced.
- A fiber having a low elastic modulus is disposed in the throat part.
- The weight rate of the fiber in the throat part is reduced, and the weight rate of the resin in the throat part is increased.
- The curvature radius Ks of the throat part is reduced in the front view of the racket.

As shown in the front view of FIG. 1, the throat parts 14 are protrudedly curved to the inner side in the plan view of the racket. When the curvature radius Ks of the throat part is reduced, the right side throat part 14 and the left side throat part 14 approach each other to reduce an area of a portion surrounded by the two throat parts 14 and the yoke part 20. When the curvature radius Ks of the throat part is reduced, the throat rigidity Rs tends to be reduced.

In order to increase the throat rigidity Rs, the following constitutions can be employed.

- The thickness of the throat part is increased.
- A fiber having a high elastic modulus is disposed in the throat part.
- The weight rate of the fiber in the throat part is increased, and the weight rate of the resin in the throat part is reduced.
- The curvature radius Ks of the throat part is increased in the front view of the racket.

As shown in the front view of FIG. 1, the throat parts 14 are protrudedly curved to the inner side in the plan view of the racket. When the curvature radius Ks of the throat part is increased, the throat parts 14 are approximately linear to separate the right side throat part 14 and the left side throat part 14. In this case, therefore, the area of the portion surrounded by the two throat parts 14 and the yoke part 20 is increased. Accordingly, when the curvature radius Ks of the throat part is increased, the throat rigidity Rs tends to be increased.

In order to increase the ratio [Rh/Rs], the plane rigidity Rh is increased, or the throat rigidity Rs is reduced. It is more effective to increase the plane rigidity Rh and to reduce the throat rigidity Rs.

In order to reduce the ratio [Rh/Rs], the plane rigidity Rh is reduced, or the throat rigidity Rs is increased. It is more effective to reduce the plane rigidity Rh and to increase the throat rigidity Rs.

The number of the fiber reinforced resinous layers is usually plural. In respect of the hitting feeling, all the fiber reinforced resinous layers may be the layer (L1) having the rubber component.

In comparing under condition of the same rate Rg, it turned out that vibration absorbing performance in a case where the layer (L1) and a layer (L2) are used in combination tends to be enhanced as compared to that in a case where all the layers are the layer (L1). This layer (L2) is a layer in which the rubber component is not blended.

A total weight of the matrix in all the layers (L1) is defined as Mm (g), and a total weight of the rubber component in all the layers (L1) is defined as Mg (g). In view of enhancing the vibration absorbing performance, a rate RL1 (%) of the weight Mg to the weight Mm is preferably equal to or greater than 5(%), more preferably equal to or greater than 10(%), and still more preferably equal to or greater than 12.5(%). This rate RL1 (%) can be calculated by the following equation.

$$RL1=(Mg/Mm)\times 100$$

In respect of heat resistance, the rate RL1 (%) is preferably equal to or less than 50(%), and more preferably equal to or less than 40(%).

When the dispersion of the rubber component is ununiform, a portion in which the rubber component is unevenly distributed is apt to cause reduction in strength. When the dispersion of the rubber component is ununiform, fluctuation in product performance is apt to occur. In these respects, the rubber component is preferably dispersed in the state of primary particles in the matrix. More preferably, the rubber component is contained in a core shell polymer. Still more preferably, this core shell polymer is dispersed in the state of primary particles in the matrix of the layer (L1).

An aggregate composed of a plurality of aggregated particles has a diameter of, for example, several tens to several hundreds μm. This aggregate is commercially available as powder. In order to suppress the separation of the aggregate from the epoxy resin, it is usually necessary to diligently mix the aggregate with the epoxy resin. More specifically, this mixing requires steps such as a step of pulverizing the aggregate to 10 μm or less, a step of stirring the aggregate while heating the aggregate at a temperature of 50 to about 200° C., a step of performing high-speed shearing stirring, and a step of mixing the aggregate using a kneading machine (a heat roll, an inter mixer, and a kneader or the like) for prolonged periods of time. Even when the mixing and the kneading are performed for several hours, rubber particles are apt to be unfortunately separated from the epoxy resin. The dispersion of the core shell polymer in the state of primary particles enables highly uniform dispersion.

Preferably, the matrix of the layer (L1) primarily contains an epoxy resin. Preferably, this matrix of the layer (L1) contains the epoxy resin, and a curing agent in addition to the rubber component. The epoxy resin of the matrix of the layer (L1) is preferably a bisphenol A type epoxy resin and/or a phenol novolak type epoxy resin. The curing agent of the resin contained in the layer (L1) is preferably dicyandiamide and/or an aromatic urea compound.

The layer (L2) contains no rubber component. Preferably, the matrix of the layer (L2) in which the rubber component is not blended primarily contains an epoxy resin. Preferably, this matrix of the layer (L2) contains the epoxy resin and a curing agent. The epoxy resin of the matrix of the layer (L2) is preferably a bisphenol A type epoxy resin and/or a phenol novolak type epoxy resin. The curing agent of the matrix of the layer (L2) is preferably dicyandiamide and/or an aromatic urea compound.

An epoxy resin 2 of the matrix of the layer (L2) may be the same as, or different from an epoxy resin 1 of the matrix of the layer (L1). In respect of adhesion between the layer (L1) and the layer (L2), at least one of the epoxy resins 1 is preferably the same as at least one of the epoxy resins 2. In respect of the adhesion between the layer (L1) and the layer (L2), at least one of the curing agents of the layer (L1) is preferably the same as at least one of the curing agents of the layer (L2).

A fiber contained in the layer (L2) may be the same as, or different from a fiber contained in the layer (L1). In respect of the frame strength, the fiber of the layer (L1) is preferably the same as the fiber of the layer (L2).

[Core Shell Polymer]

The core shell polymer has a core part and a shell part. Preferably, the core part is made of a polymer primarily containing an elastomer and/or a rubbery polymer. Preferably, the shell part is made of a polymer component graft-polymerized to the core part. The preferable shell part is formed by graft-polymerizing a monomer constituting a graft component to a core component. The shell part covers the core part partially or wholly.

The polymer constituting the core part is crosslinked. The polymer constituting the core part is preferably insoluble in the epoxy resin. In respect of enhancing the vibration absorbing performance, it is preferable that the polymer of the core part has rubber properties. In this respect, a glass transition temperature (Tg) of the polymer of the core part is preferably equal to or less than 0° C., and more preferably equal to or less than −10° C.

The polymer constituting the core part is preferably the following polymer (Pa), polymer (Pb), or polymer (Pc):

(Pa) a polymer obtained by polymerizing a monomer containing 50% by weight or greater of one or more monomers selected from the group consisting of a conjugated diene monomer and a (meth) acrylic ester monomer;

(Pb) polysiloxane rubber; and (Pc) a mixture of the polymer (Pa) and the polymer (Pb).

In the present application, (meth)acrylic means acrylic and/or methacryl.

Examples of the conjugated diene monomer include butadiene, isoprene, and chloroprene. In respects of inexpensive cost, good vibration absorbing performance of the polymer, and facile polymerization, butadiene is particularly preferable.

Examples of the (meth)acrylic ester monomer include butyl acrylate, 2-ethylhexyl acrylate, and lauryl methacrylate. In respects of good vibration absorbing performance of the polymer and facile polymerization, butyl acrylate and 2-ethylhexyl acrylate are particularly preferable.

The conjugated diene monomer and the (meth)acrylic ester monomer may be used alone, or two or more of them may be used in combination. The amount of the conjugated diene monomer and the (meth)acrylic ester monomer to be used is preferably equal to or greater than 50% by weight based on the weight of the whole core part, and more preferably equal to or greater than 60% by weight. When the amount is less than 50% by weight, the toughness of the matrix may reduced. This toughness can enhance the strength of the racket frame.

When the conjugated diene monomer and/or the (meth) acrylic ester monomer are primarily contained as a raw material polymer of the core part, one or more vinyl monomers which can be copolymerized therewith may be copolymerized. Examples of the vinyl monomer include alkyl (meth) acrylate (a (meth)acrylate monomer) other than a alkyl (meth)acrylate, a vinyl aromatic monomer, and a vinyl cyanide monomer. Examples of the (meth)acrylate monomer include methyl (meth)acrylate, ethyl (meth)acrylate, and butyl (meth)acrylate. Examples of the vinyl aromatic monomer include styrene and α-methylstyrene. Examples of the vinyl cyanide monomer include (meth)acrylonitrile and substituted acrylonitrile. These copolymerizable monomers can be used alone, or two or more of them can be used. A rate of these copolymerizable monomers to be used is preferably less than 50% by weight based on the weight of the whole core part, and more preferably less than 40% by weight.

A polyfunctional monomer may be used as the raw material polymer of the core part. This poly functional monomer can contribute to the regulation of crosslink degree. Examples of the polyfunctional monomer include divinylbenzene, butane diol di(meth)acrylate, triallyl (iso)cyanurate, allyl (meth)acrylate, diallyl itaconate, and diallyl phthalate. In respect of the vibration absorbing performance of the racket frame, a rate of these polyfunctional monomers to be used is preferably equal to or less than 10% by weight based on the whole weight of the core part, more preferably equal to or less than 5% by weight, and still more preferably equal to or less than 3% by weight.

Polysiloxane rubber may be used for the core part in place of the vinyl polymerizable polymers, or in combination with the vinyl polymerizable polymers. When the polysiloxane rubber is used for the core part, examples of a constitutional unit of polysiloxane include alkyl di-substituted silyloxyl or aryl di-substituted silyloxyl such as dimethylsilyloxyl, methylphenylsilyloxyl, and diphenylsilyloxyl. When this polysiloxane rubber is used, it is preferable that a crosslinked structure is previously introduced. Examples of a technique for the introduction include using a polyfunctional alkoxysilane compound in combination in the polymerization of the core part, and free-radical reacting a silane compound having a vinyl reactive group.

The shell part has a group having an affinity to the epoxy resin. The shell part applies the affinity to the epoxy resin, to the core shell polymer. This affinity tends to cause the dispersion of the core shell polymer in the state of primary particles in the epoxy resin.

The polymer constituting the shell part is preferably graft-polymerized to the polymer constituting the core part. The polymer constituting the shell part is preferably bonded to the polymer constituting the core part. Specifically, 70% by weight or greater of the polymer constituting the shell part is preferably bonded to the core part, more preferably 80% by weight or greater, and still more preferably 90% by weight or greater. In respect of stably dispersing the core shell polymer in the state of primary particles, it is preferable that the shell part has a swelling property, compatibility, and/or an affinity to an organic solvent to be described later and the epoxy resin of the matrix.

In respect of the strength of the racket frame, it is preferable that the shell part has reactivity with the epoxy resin of the matrix or the curing agent of the epoxy resin. In respect of the strength of the racket frame, the epoxy resin or the curing agent may be bonded to the shell part by chemical reaction.

In respects of cost, good graft polymerizability, and the affinity to the epoxy resin, the polymer constituting the shell part is preferably a polymer obtained by polymerizing one or more components selected from a (meth) acrylic ester, an aromatic vinyl compound, and a vinyl cyanide compound.

In view of enhancing the chemical reactivity of the shell part in the curing of the epoxy resin, in addition to the monomer, one or more monomers selected from the group consisting of (meth)acrylic esters having a reactive side chain such as alkyl (meth)acrylate, hydroxyalkyl (meth)acrylate, and epoxyalkyl (meth)acrylate; epoxy alkyl vinyl ether; (meth) acryl amide (which includes an N-substitute); α,β-unsaturated acid; α,β-unsaturated acid anhydride; and a maleimide derivative are preferably copolymered. Examples of these monomer include methyl (meth)acrylate, ethyl (meth)acrylate, butyl (meth)acrylate, styrene, α-methylstyrene, (meth) acrylonitrile, (meth) acrylic acid, 2-hydroxyethyl (meth) acrylate, glycidyl (meth)acrylate, glycidyl vinyl ether, (meth) acryl amide, maleic anhydride, and maleic imide. However, the monomer is not limited thereto. They may be may be used alone, or two or more of them may be used in combination.

A mass ratio of the core part to the shell part is not limited. In respects of improving the toughness of the epoxy resin to enhance the strength of the racket frame, and of the vibration absorbing performance, a ratio [a mass of the core part/a mass of the shell part] is preferably equal to or greater than 50/50, and more preferably equal to or greater than 60/40. In view of dispersing the core shell polymer in the state of primary particles, this ratio [the mass of the core part/the mass of the shell part] is preferably equal to or less than 95/5, and more preferably equal to or less than 90/10.

A manufacturing method of the core shell polymer is not limited. Examples of the manufacturing method include emulsion polymerization, suspension polymerization, and microsuspension polymerization. The emulsion polymerization is preferable.

A volume-average particle diameter of the core shell polymer is not limited. In respect of the strength of the racket frame, this volume-average particle diameter is preferably equal to or less than 1 μm. When the volume-average particle diameter is excessively small, the core shell polymer is hard to disperse in the state of primary particles. In this respect, the volume-average particle diameter is preferably equal to or greater than 0.03 μm. The volume-average particle diameter can be measured using Microtrack UPA (manufactured by Nikkiso Co., Ltd.).

The preferable matrix is an epoxy resin composition. This epoxy resin composition is preferably obtained by the following manufacturing method. This preferable manufacturing method includes the steps of: mixing a core shell polymer obtained in an aqueous latex state with an organic solvent and taking out the core shell polymer into an organic phase to obtain a dispersion having the core shell polymer dispersed in the organic solvent; and mixing this dispersion with an epoxy resin.

One example of a more preferable manufacturing method includes the step of mixing an aqueous latex containing a core shell polymer with an organic solvent, and separating and removing an aqueous phase to obtain a dispersion having the core shell polymer dispersed in the organic solvent. In this step, preferably, after the aqueous latex of the core shell polymer is mixed with the organic solvent, an organic solvent having immiscibility with an aqueous electrolyte or the aqueous latex is further added, and the aqueous phase is separated and removed to obtain a dispersion having the core shell polymer dispersed in the organic solvent. The epoxy resin composition can be manufactured by mixing this dispersion with an epoxy resin, and removing a volatilization component containing the organic solvent if needed. A more preferable manufacturing method of the epoxy resin composition includes the steps of: bringing the dispersion into contact with water or an aqueous electrolyte solution; thereafter performing one or more operations for separating and removing an aqueous phase; and thereafter mixing the dispersion with an epoxy resin.

Examples of the organic solvent mixed with the aqueous latex containing the core shell polymer include one or more organic solvents selected from esters such as methyl acetate, ethyl acetate, propyl acetate, and butyl acetate; ketones such as acetone, methyl ethyl ketone, diethyl ketone, and methyl isobutyl ketone; alcohols such as ethanol, (iso)propanol, and butanol; ethers such as tetrahydrofuran, tetrahydropyran, dioxane, and diethyl ether; aromatic hydrocarbons such as benzene, toluene, and xylene; and halogenated hydrocarbons such as methylene chloride and chloroform, or a mixture thereof. The solubility of this organic solvent in water at 20° C. is preferably 5% by weight or greater and 40% by weight or less. When this solubility is less than 5% by weight, it tends to become slightly difficult to mix the organic solvent with the aqueous latex containing the core shell polymer. When the solubility exceeds 40% by weight, it may become difficult to efficiently separate and remove the aqueous phase after adding the organic solvent having immiscibility with the aqueous electrolyte or the aqueous latex.

As the organic solvent having immiscibility with the aqueous latex, known organic solvents can be used. Examples thereof include one or more organic solvents selected from esters such as ethyl acetate, propyl acetate, and butyl acetate; ketones such as diethyl ketone, and methyl isobutyl ketone; ethers such as diethyl ether, and butyl ether; aromatic hydrocarbons such as benzene, toluene, and xylene; aliphatic hydrocarbon such as hexane; and halogenated hydrocarbons such as methylene chloride and chloroform. The solubility of the organic solvent in water is preferably less than 5% by weight. When the solubility of the organic solvent in water is equal to or greater than 5% by weight, and the organic solvent is added into a mixture of the aqueous latex containing the core shell polymer and the organic solvent, an effect of efficiently separating the aqueous phase is apt to be reduced.

The aqueous electrolyte is not particularly limited. Specific examples of the aqueous electrolyte include aqueous alkali metal salts, alkali earth metal salts, and ammonium salts. More specifically, sodium chloride, potassium chloride, calcium chloride, magnesium chloride, sodium sulfate, potassium sulfate, magnesium sulfate, sodium phosphate, potassium phosphate, calcium phosphate, and ammonium sulfate or the like are exemplified. Furthermore, inorganic acids such as hydrochloric acid and sulfuric acid are exemplified. When the organic solvent having immiscibility with the aqueous latex is not added into a mixture of the aqueous latex and the specific organic solvent and this aqueous electrolyte is not added into the mixture, it may be difficult to efficiently separate and remove the aqueous phase.

Additives such as a curing agent, a crosslinking agent, a filler, a pigment, a coupling agent, a leveling agent, an oxidation inhibitor, a solvent, a dispersion stabilizer, a reactive diluent, an adhesion imparting agent, an antifoaming agent, a lubricant, perfume, a thermoplastic resin, a promoter, and a thixotropic agent may be blended in the matrix.

The core shell polymer may be an aggregate obtained by aggregation of a plurality of primary particles. Examples of the aggregate include "Kane Ace" (trade name) manufactured by Kaneka Corporation, and "Paraloid" (trade name) manufactured by Rohm and Haas. The volume-average particle diameter of the aggregate is, for example, 10 μm or greater and 1,000 μm or less.

Preferably, the core shell polymer is dispersed in the state of primary particles in the matrix. This dispersion tends to cause the equal dispersion of the rubber component in the matrix. The dispersion can enhance the strength. The dispersion suppresses fluctuation in product performance.

The manufacturing method of the racket frame is not limited. As this manufacturing method, the following [manufacturing method A], [manufacturing method B], [manufacturing method C], and [manufacturing method D] are exemplified.

[Manufacturing Method A]

[The manufacturing method A] includes the following [step A1], [step A2], [step A3], [step A4], [step A5], and [step A6].

[Step A1]: a step of preparing an epoxy resin composition containing rubber particles, an epoxy resin, and a curing agent.

[Step A2]: a step of winding a carbon fiber around a drum while immersing the carbon fiber in the epoxy resin composition to obtain a wound body.

[Step A3]: a step of cutting off the wound body from the drum, and applying heat of 80° C. or higher and 100° C. or lower thereto to obtain a semi-cured prepreg.

[Step A4]: a step of cutting the prepreg.

[Step A5]: a step of passing a mandrel through a tube (made of nylon or silicone or the like), winding the cut prepreg around the tube, and thereafter extracting the mandrel from the tube to obtain a prepreg intermediate member in which the prepreg is wound around the tube.

[Step A6]: a forming step of setting the prepreg intermediate member to a mold of a racket frame, applying inner pressure on the tube to provide the prepreg intermediate member along the mold, and thereafter heating the prepreg intermediate member to cure a matrix.

[Manufacturing Method B]

[The manufacturing method B] includes the following [step B1], [step B2], [step B3], [step B4], and [step B5].

[Step B1]: a step of preparing an epoxy resin composition containing rubber particles, an epoxy resin, and a curing agent.

[Step B2]: a step of preparing a tube with through which a mandrel is passed.

[Step B3]: a step of winding a carbon fiber around the tube through which the mandrel is passed, by a filament winding (FW) method while attaching the epoxy resin composition to the carbon fiber.

[Step B4]: a step of extracting the mandrel from the tube to obtain an FW intermediate member.

[Step B5]: a step of setting the FW intermediate member to a mold of a racket frame, applying inner pressure on the tube to provide the tube or the like along the mold, and thereafter heating the tube to cure a matrix.

[Manufacturing Method C]

[The manufacturing method C] includes the following [step C1], [step C2], [step C3], [step C4], [step C5], and [step C6].

[Step C1]: a step of preparing an epoxy resin composition containing rubber particles, an epoxy resin, and a curing agent.

[Step C2]: a step of preparing a braid composed of braided fibers.

[Step C3]: a step of preparing a tube through which a mandrel is passed.

[Step C4]: a step of laminating the braid around the tube through which the mandrel is passed while attaching the epoxy resin composition to the braid to obtain a layup C (fiber formed body).

[Step C5]: a step of extracting the mandrel from the tube to obtain a resin impregnated layup C.

[Step C6]: a step of setting the resin impregnated layup C to a mold of a racket frame, applying inner pressure on the tube to provide the resin impregnated layup C along the mold, and thereafter heating the resin impregnated layup C to cure a matrix.

[Manufacturing Method D]

[The manufacturing method D] includes the following [step D1], [step D2], [step D3], [step D4], [step D5], and [step D6].

[Step D1]: a step of preparing an epoxy resin containing rubber particles, an epoxy resin, and a curing agent, and/or an epoxy resin composition which may contain a diluent.

[Step D2]: a step of preparing a braid composed of braided fibers.

[Step D3]: a step of preparing a tube through which a mandrel is passed.

[Step D4]: a step of laminating the braid around the tube through which the mandrel is passed to obtain a layup D (fiber formed body).

[Step D5]: a step of extracting the mandrel from the tube, and thereafter attaching a resin to the layup D with the tube to obtain a resin impregnated layup D.

[Step D6]: a step of setting the resin impregnated layup D to a mold of a racket frame, applying inner pressure on the tube to provide the resin impregnated layup D along the mold, and heating the resin impregnated layup D to cure a matrix.

When making the layer (L1) in which the rubber component is blended and the layer (L2) in which the rubber component is not blended coexist, for example, [the manufacturing method A] can be employed. In this case, a prepreg Pg in which the rubber component is blended in the matrix, and a prepreg Pn in which the rubber component is not blended in the matrix may be separately produced by [the step A1], [the step A2], and [the step A3] of [the manufacturing method A], and the prepreg Pg and prepreg Pn may be used in combination in [the step A5].

EXAMPLES

Hereinafter, the effects of the present invention will be clarified by examples. However, the present invention should not be interpreted in a limited way based on the description of the examples.

Example 1

[The manufacturing method A] was used in the production of this racket frame. As the "epoxy resin containing rubber particles" of [the step A1], "MX-156" (trade name) manufactured by Kaneka Corporation was used. "MX-156" contains the core shell polymer. In "MX-156", the weight of a rubber component, more specifically, the core shell polymer accounts for 25% by weight. The core shell polymer is dispersed in the state of primary particles in a matrix of the racket frame by using "MX-156".

A type of the epoxy resin contained in "MX-156" is a bisphenol A type. The epoxy resin contained in "MX-156" is "Epicoat 828" to be described later. The rubber component of the core shell polymer contained in "MX-156" is polybutadiene rubber. The particle diameter of the core shell polymer is about 0.1 μm.

"Epicoat 828" (trade name) is an epoxy resin manufactured by Mitsubishi Chemical Corporation. "EPICLON N-865" (trade name) is a phenol novolak type epoxy resin manufactured by DIC Corporation. "DICY" (trade name) is dicyandiamide, and is a curing agent manufactured by Mitsubishi Chemical Corporation. "DCMU" (trade name) is an aromatic urea compound manufactured by Hodogaya Chemical Co., Ltd., and is a curing agent. These were mixed in a weight ratio described in Table 1 to obtain the epoxy resin composition of [the step A1]. A racket frame of example 1 was obtained by [the manufacturing method A]. A face area was set to 645 $cm^2$. A full length was set to 27 inches. A frame weight was set to 290 (g), and balance was set to 325 (mm). Strings (guts) were stretched, and a grip tape was mounted to obtain a racket of an example 1.

Examples 2 to 6

Racket frames and rackets of examples 2 to 6 were obtained in the same manner as in the example 1 except that the blending of the epoxy resin composition was set as shown in Table 1.

Example 7

An epoxy resin composition 1 containing a rubber component was obtained by the blending for a layer (L1) described in Table 1. A prepreg 1 was obtained using this epoxy resin composition 1 in [the step A2] and [the step A3]. This prepreg 1 was cut in [the step A4]. An epoxy resin composition 2 containing no rubber component was obtained by the blending for a layer (L2) described in Table 1. A prepreg 2 was obtained using this epoxy resin composition 2 in [the step A2] and [the step A3]. This prepreg 2 was cut in [the step A4].

[The step A5] was performed using the prepreg 1 and the prepreg 2. For the lamination order of the prepreg 1 and the prepreg 2, the prepreg 2 was set as an inner layer, and the prepreg 1 was set as an outer layer. The laminated thickness of the prepreg 2 was set to be the same as that of the prepreg 1. The orientation of a carbon fiber was set to be the same as those of the examples 1 to 6. A racket frame and a racket of example 7 were obtained in the same manner as in the example 1 except for the orientation of the carbon fiber.

Comparative Examples 1 to 4

Racket frames and rackets of comparative examples 1 to 4 were obtained in the same manner as in the example 1 except that the blending of the epoxy resin composition was set as shown in Table 2.

Specifications and results of evaluation of the examples are shown in the following Table 1. Specifications and results of evaluation of the comparative examples are shown in the following Table 2. In Tables 1 and 2, the blending unit is part by weight.

The "balance" is a distance between a grip end and a center of gravity of the frame.

[Evaluation]

Plane rigidity Rh and throat rigidity Rs and a vibration damping rate of each of the obtained racket frame were evaluated. Strength, heat resistance, and hitting feeling of each of the obtained rackets (having the stretched strings) were evaluated. Valuation methods are as follows.

[Measurement of Plane Rigidity Rh]

Figure 2:
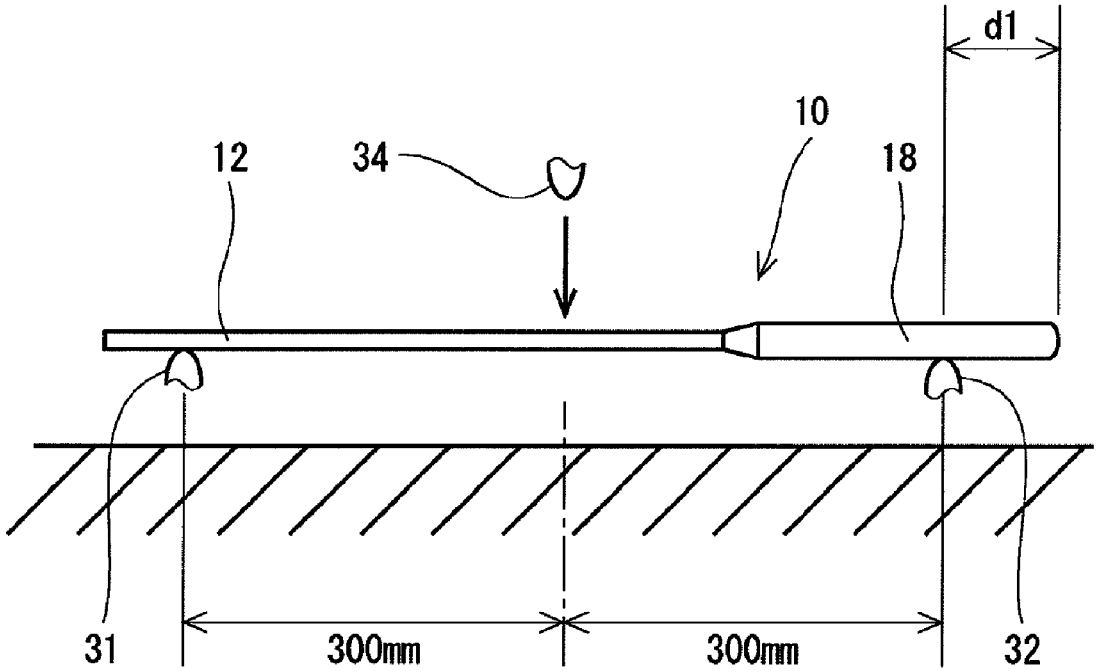
FIG. 2 shows a method for measuring plane rigidity Rh.

As shown in FIG. 2, the racket frame was horizontally disposed. A head part 12 was supported from below by a jig 31, and a grip part 18 was supported from below by a jig 32.

A distance d1 between the grip end and a contact point of the jig 32 was set to 43 mm. A distance between the jig 31 and the jig 32 was 600 mm. For the shape of the upper surface of the jig 31, a curvature radius in a cross section in the longitudinal direction of the racket was set to 15 (mm), a curvature radius in a cross section in a direction perpendicular to the longitudinal direction of the racket (a direction perpendicular to the plane of FIG. 2) was made infinite (more specifically, a straight line). The shape of the upper surface of the jig 32 was set to be the same as that of the jig 31. An indenter 34 was set in a central point between the jig 31 and the jig 32. This indenter 34 applied a force of 80 kgf going downward from above. For the shape of the under surface of the indenter 34, a curvature radius in a cross section in the longitudinal direction of the racket was set to 10 (mm), a curvature radius in a cross section in the direction perpendicular to the longitudinal direction of the racket (the direction perpendicular to the plane of FIG. 2) was made infinite (more specifically, a straight line). Plane rigidity (kgf/cm) was calculated by dividing a load by a displacement amount in the vertical direction of a middle point with which this indenter 34 was brought into contact. These results are shown in the following Tables 1 and 2.

[Measurement of Throat Rigidity Rs]

Figure 3A:
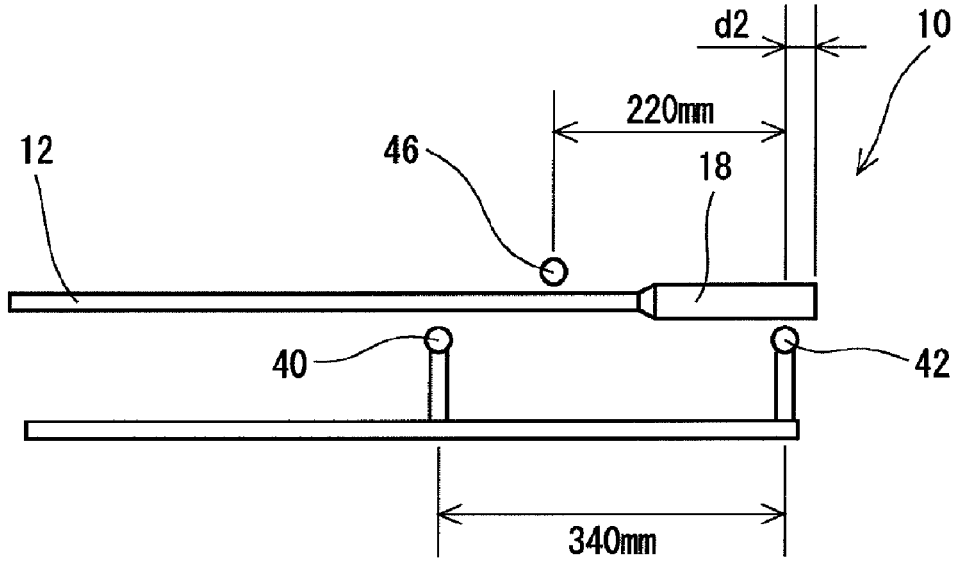
FIG. 3A shows a method for measuring throat rigidity Rs.
Figure 3B:
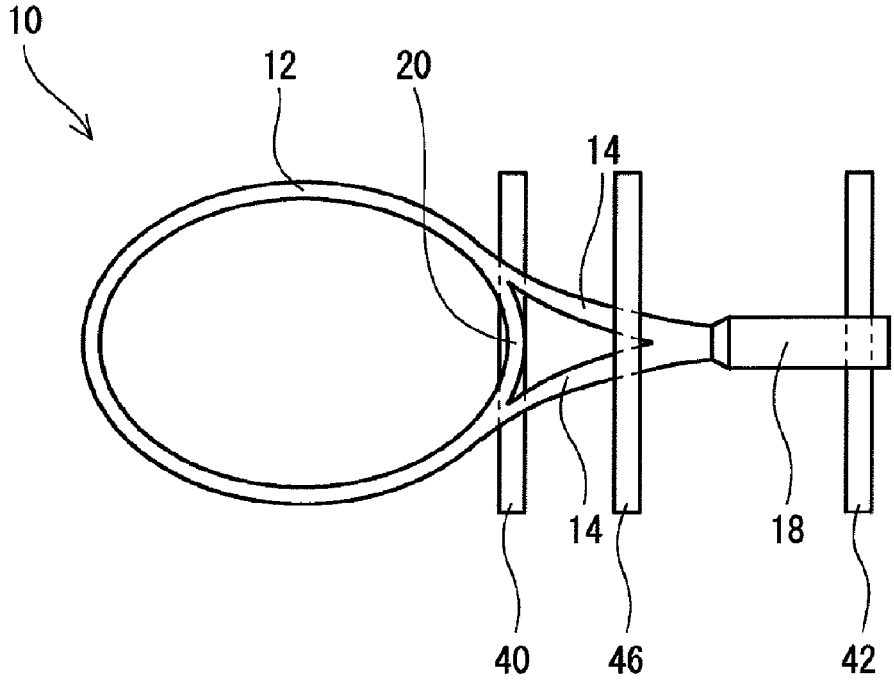
FIG. 3B shows a method for measuring throat rigidity Rs.

FIG. 3A shows a condition for measuring throat rigidity Rs, viewed from the lateral side. FIG. 3B shows a condition for measuring throat rigidity Rs, viewed from above. As shown in FIGS. 3A and 3B, the racket frame was horizontally disposed. The vicinity of a yoke part 20 was supported from below by a jig 40, and the grip part 18 was supported from below by a jig 42. A distance d2 between the grip end and a contact point of the jig 42 was set to 25 mm. A distance between the jig 40 and the jig 42 was 340 mm. For the shape of the upper surface of the jig 40, a curvature radius in a cross section in the longitudinal direction of the racket was set to 15 (mm), a curvature radius in a cross section in a direction perpendicular to the longitudinal direction of the racket (a direction perpendicular to the plane of FIG. 3A) was made infinite (more specifically, a straight line). The shape of the upper surface of the jig 42 was set to be the same as that of the jig 40. An indenter 46 was set between the jig 40 and the jig 42. A distance between the contact point of the indenter 46 and the contact point of the jig 42 was set to 220 mm. This indenter 46 applied a force of 80 kgf going downward from above. For the shape of the under surface of the indenter 46, a curvature radius in a cross section in the longitudinal direction of the racket was set to 10 (mm), a curvature radius in a cross section in the direction perpendicular to the longitudinal direction of the racket (the direction perpendicular to the plane of FIG. 3A) was made infinite (more specifically, a straight line). The throat rigidity Rs (kgf/cm) was calculated by dividing a load by a displacement amount in the vertical direction of a point with which this indenter 46 was brought into contact. These results are shown in the following Tables 1 and 2.

[Vibration Damping Rate]

Figure 4:
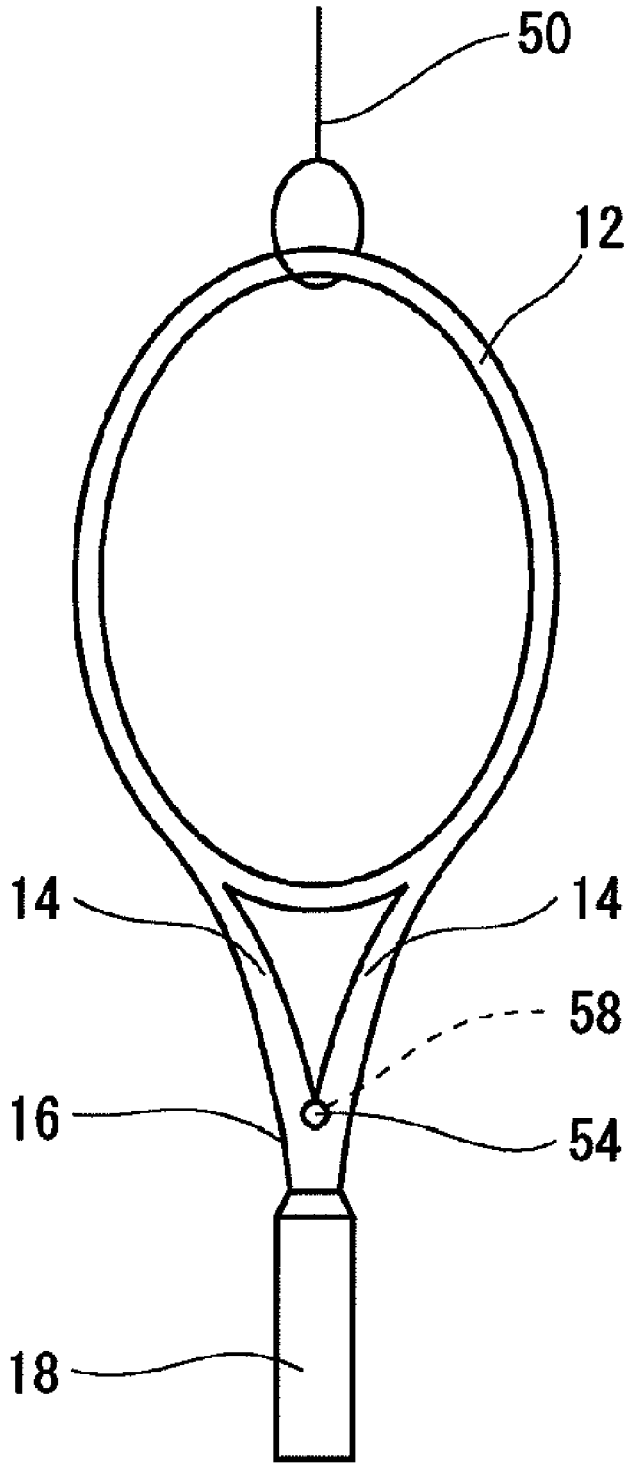
FIG. 4 shows a method for measuring a vibration damping rate Rv.
Figure 5:
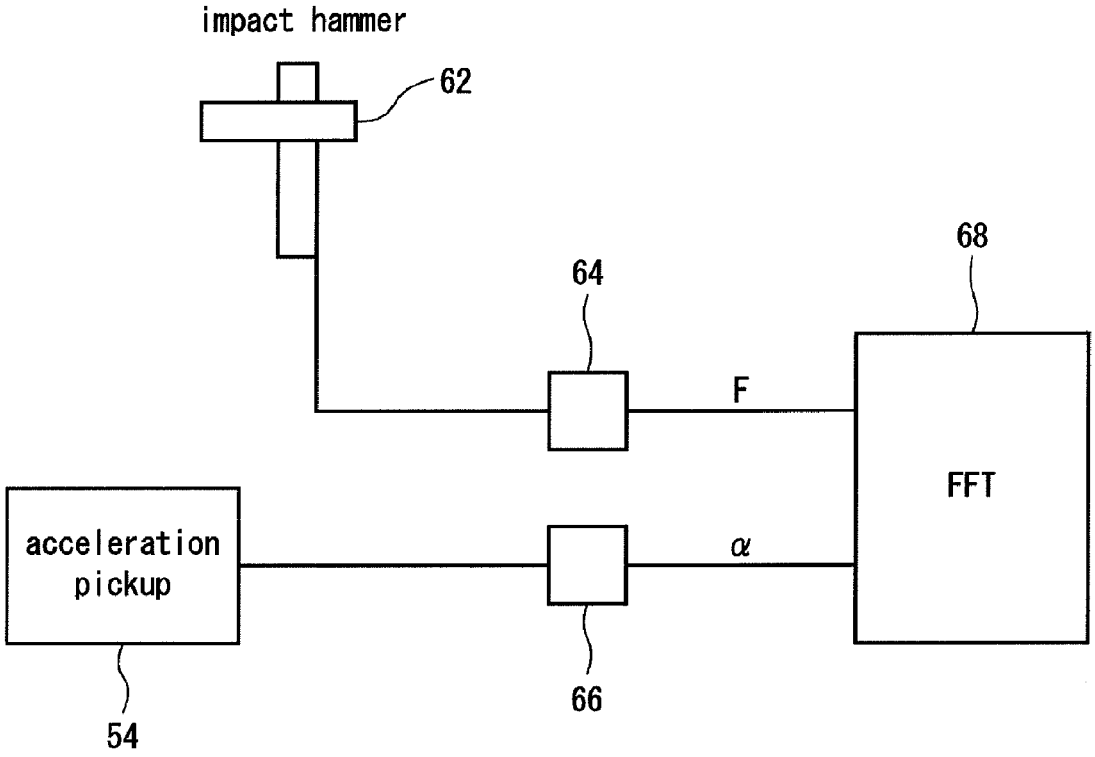
FIG. 5 shows a schematic configuration of a device for measuring the vibration damping rate Rv.
Figure 6:
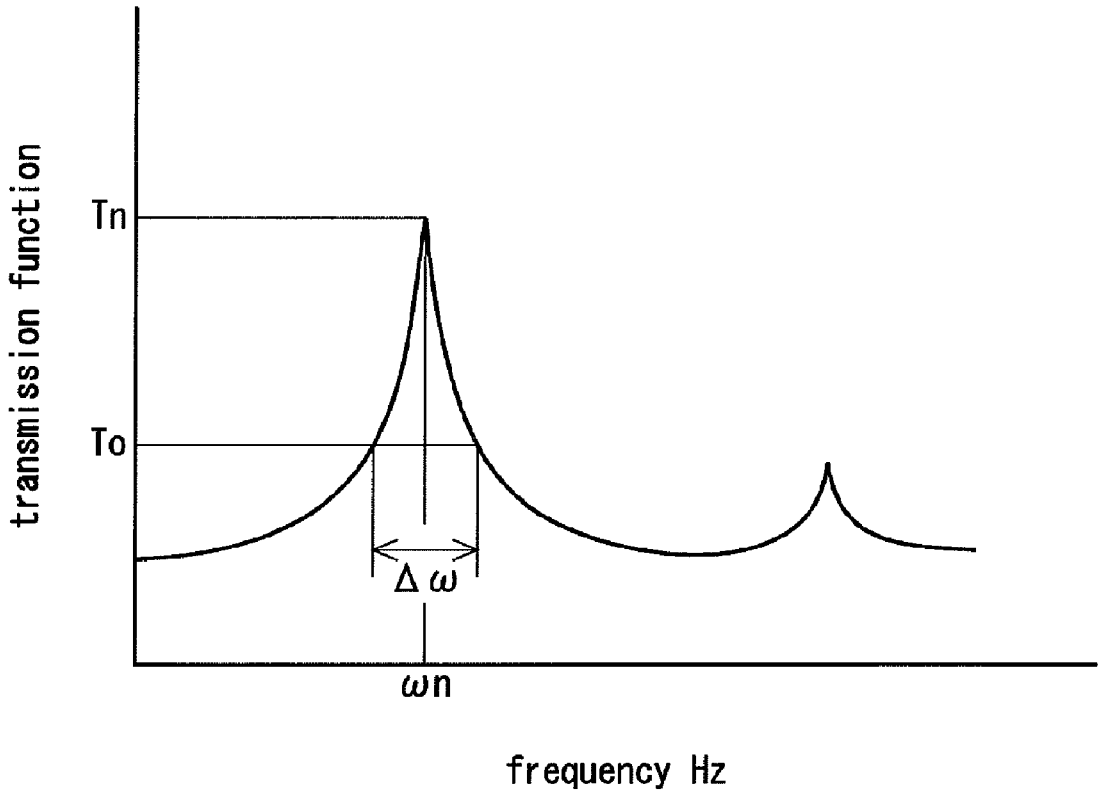
FIG. 6 is a graph for calculating the vibration damping rate Rv.

FIG. 4 shows a condition for measuring a vibration damping rate. FIG. 5 shows a schematic configuration of a device used for this measurement. As shown in FIG. 4, the upper end of the head part 12 was hung with a string 50, and an acceleration pickup 54 was fixed to a boundary part between throat parts 14 and a shaft part 16. The acceleration pickup 54 was mounted so that the measurement direction thereof is perpendicular to a frame face. In this state, a back side 58 of the acceleration pickup 54 was hit and vibrated with an impact hammer 62. A force pickup meter is mounted to the impact hammer 62. Response vibration (F) measured by this force pickup meter and response vibration (a) measured by the acceleration pickup 54 were input to a frequency analyzer 68 via amplifiers 64 and 66, and were analyzed. The response vibration (F) is an input vibrating force. The response vibration (a) is response acceleration. As this frequency analyzer 68, dynamic single analyzer HP3562A manufactured by Hewlett-Packard Company. was used. A transmission function in a frequency region obtained by the analysis was determined to obtain the number of vibrations of the racket frame. An example of a graph of the obtained transmission function is shown in FIG. 6. In the graph of FIG. 6, a horizontal axis is frequency (Hz) and a vertical axis is a transmission function. The transmission function is [the response vibration ($\alpha$)/the response vibration (F)]. When the acceleration pickup 54 is mounted to the position and the back side 58 of this position is vibrated, out-of-plane secondary vibration is measured. Therefore, the primary maximal value of this transmission function is the primary maximal value in the out-of-plane secondary vibration. A vibration damping rate Rv which is a damping rate of the out-of-plane secondary vibration is calculated by the following equations (1) and (2).

$$Rv=(1/2)\times(\Delta\omega/\omega n) \quad (1)$$

$$T0=Tn/\sqrt{2} \quad (2)$$

As shown in the graph of FIG. 6, $\omega n$ is the frequency of the primary maximal value. The meanings of $\Delta\omega$, Tn, and T0 are shown in the graph of FIG. 6.

The vibration damping rate of each of the racket frames was measured five times. The average values of the measured five vibration damping rates Rv are shown in the following Tables 1 and 2.

[Strength]

A ball of which a speed was 50 m/s collided with the string face of the racket having the stretched strings. Collision frequency N1 until damages such as cracks occurred in the racket frame was counted. A case where the collision frequency N1 was equal to or less than 100 was set to be "C". A case where the collision frequency N1 exceeded 100 and was equal to or less than 200 was set to be "B". A case where the collision frequency N1 exceeded 200 was set to be "A". Results of evaluation thereof are shown in the following Tables 1 and 2.

[Heat Resistance]

The racket having the stretched strings was left in an oven for 2 hours, and the deformation of the racket frame was confirmed. The inside temperature of the oven was set to 90° C. A case where the racket was not deformed was set to be "A". A case where the racket was slightly deformed was set to be "B". A case where the racket was largely deformed was set to be "C". Results of evaluation thereof are shown in the following Tables 1 and 2.

[Hitting Feeling]

Ten testers having over ten years of experience in tennis and presently playing three times or more a week evaluated hitting feeling. Items of evaluation were two items of vibration absorbing performance and bite sensation. Both the items were evaluated on a 5-point scale of from one to five. The best case was defined as five points. The worst case was defined as one point. The average scores of evaluation values by the ten testers are shown in the following Tables 1 and 2.

TABLE 1

Specifications and results of evaluation of examples

| | | Example 1 | Example 2 | Example 3 | Example 4 | Example 5 | Example 6 | Example 7 |
|---|---|---|---|---|---|---|---|---|
| Fiber reinforced resinous layer (L1) | MX-156 (rubber-dispersed epoxy; rubber component of 25 wt %) | 50 | 10 | 70 | 50 | 50 | 25 | 50 |
| | Epicoat 828 | 0 | 40 | 0 | 0 | 0 | 25 | 0 |
| | EPICLON N-865 | 40 | 40 | 20 | 40 | 40 | 40 | 40 |
| | DICY | 6 | 6 | 6 | 6 | 6 | 6 | 6 |
| | DCMU | 4 | 4 | 4 | 4 | 4 | 4 | 4 |
| Fiber reinforced resinous layer (L2) | Epicoat 828 | | | | | | | 90 |
| | DICY | | | | | | | 6 |
| | DCMU | | | | | | | 4 |
| (Wg/Wm) × 100 | (% by mass) | 12.5 | 2.5 | 17.5 | 12.5 | 12.5 | 6.3 | 6.3 |
| (Mg/Mm) × 100 | (% by mass) | 12.5 | 2.5 | 17.5 | 12.5 | 12.5 | 6.3 | 12.5 |
| Plane rigidity Rh | (kgf/cm) | 57 | 60 | 55 | 40 | 58 | 59 | 58 |
| Throat rigidity Rs | (kgf/cm) | 380 | 400 | 367 | 800 | 290 | 390 | 390 |
| Ratio [Rh/Rs] | | 0.15 | 0.15 | 0.15 | 0.05 | 0.20 | 0.15 | 0.15 |
| Weight | (g) | 290 | 290 | 290 | 290 | 290 | 290 | 290 |
| Balance | (mm) | 325 | 325 | 325 | 325 | 325 | 325 | 350 |
| Vibration damping rate Rv | (%) | 0.62 | 0.35 | 0.85 | 0.61 | 0.60 | 0.44 | 0.53 |
| Strength | | A | A | A | A | A | A | A |
| Heat resistance | | A | A | B | A | A | A | A |
| Hitting feeling (vibration absorbing performance) | | 3.5 | 2.1 | 4.5 | 3.3 | 3.6 | 2.5 | 2.9 |
| Hitting feeling (bite sensation) | | 3.8 | 3.7 | 3.8 | 2.2 | 4.0 | 3.8 | 3.8 |

TABLE 2

Specifications and results of evaluation of comparative examples

| | | Comparative example 1 | Comparative example 2 | Comparative example 3 | Comparative example 4 |
|---|---|---|---|---|---|
| Fiber reinforced resinous layer (L1) | MX-156 (rubber-dispersed epoxy; rubber component of 25 wt %) | 0 | 80 | 50 | 50 |
| | Epicoat 828 | 50 | 0 | 0 | 0 |
| | EPICLON N-865 | 40 | 10 | 40 | 40 |
| | DICY | 6 | 6 | 6 | 6 |
| | DCMU | 4 | 4 | 4 | 4 |
| Fiber reinforced resinous layer (L2) | Epicoat 828 | | | | |
| | DICY | | | | |
| | DCMU | | | | |
| (Wg/Wm) × 100 | (% by mass) | 0 | 20 | 12.5 | 12.5 |
| (Mg/Mm) × 100 | (% by mass) | 0 | 20 | 12.5 | 12.5 |
| Plane rigidity Rh | (kgf/cm) | 62 | 54 | 17 | 57 |
| Throat rigidity Rs | (kgf/cm) | 413 | 360 | 840 | 248 |
| Ratio [Rh/Rs] | | 0.15 | 0.15 | 0.02 | 0.23 |
| Weight | (g) | 290 | 290 | 290 | 290 |
| Balance | (mm) | 325 | 325 | 325 | 325 |
| Vibration damping rate Rv | (%) | 0.25 | 0.97 | 0.60 | 0.59 |
| Strength | | A | B | A | C |
| Heat resistance | | A | C | A | A |
| Hitting feeling (vibration absorbing performance) | | 1.5 | 4.7 | 3.4 | 3.5 |
| Hitting feeling (bite sensation) | | 3.5 | 3.7 | 1.5 | 4.1 |

As shown in Tables 1 and 2, the examples have higher evaluation than those of the comparative examples. Advantages of the present invention are clearly indicated by the results of evaluation.

The method described above is applicable to a hard tennis racket frame and a soft tennis racket frame or the like.

The description hereinabove is merely for an illustrative example, and various modifications can be made in the scope not to depart from the principles of the present invention.

What is claimed is:

1. A racket frame comprising fiber reinforced resinous layers, wherein at least one of the fiber reinforced resinous layers is a layer (L1) containing a rubber component;

when a total weight of a matrix in the whole racket frame is defined as Wm (g) and a total weight of the rubber component in the whole racket frame is defined as Wg (g), a rate Rg (%) of the weight Wg to the weight Wm is 2.5(%) or greater and 17.5(%) or less, and a ratio [Rh/Rs] of plane rigidity Rh (kgf/cm) to throat rigidity Rs (kgf/cm) is 0.05 or greater and 0.2 or less.

2. The racket frame according to claim 1, wherein the plane rigidity Rh is 30 (kgf/cm) or greater and 70 (kgf/cm) or less; and the throat rigidity Rs is 250 (kgf/cm) or greater and 800 (kgf/cm) or less.

3. The racket frame according to claim 1, wherein the layer (L1) containing the rubber component and a layer (L2) containing no rubber component are used in combination as the fiber reinforced resinous layers.

4. The racket frame according to claim 1, wherein the rubber component is a core shell polymer; and the core shell polymer is dispersed in the state of primary particles in a matrix of the layer (L1).

5. The racket frame according to claim 1, wherein rubber of the rubber component is diene rubber, non-diene rubber, or a thermoplastic elastomer.

6. The racket frame according to claim 1, wherein the rubber component is dispersed in the form of particles in the matrix.

7. The racket frame according to claim 1, wherein when a total weight of the matrix in all the layers (L1) is defined as Mm (g) and a total weight of the rubber component in all the layers (L1) is defined as Mg (g), a rate RL1 (%) calculated by the following equation is 5(%) or greater and 50(%) or less.

$$RL1=(Mg/Mm)\times 100$$

8. The racket frame according to claim 1, wherein a principal component of a matrix of the layer (L1) is the rubber component, an epoxy resin, or a curing agent;

the epoxy resin is a bisphenol A type epoxy resin and/or a phenol novolak type epoxy resin; and the curing agent is dicyandiamide and/or an aromatic urea compound.

9. The racket frame according to claim 3, wherein a principal component of a matrix of the layer (L2) is an epoxy resin or a curing agent;

the epoxy resin is a bisphenol A type epoxy resin and/or a phenol novolak type epoxy resin; and the curing agent is dicyandiamide and/or an aromatic urea compound.

10. The racket frame according to claim 3, wherein the matrix of the layer (L1) contains an epoxy resin 1 and a curing agent 1;

the matrix of the layer (L2) contains an epoxy resin 2 and a curing agent 2;

the epoxy resin 1 is the same as the epoxy resins 2; and the curing agent 1 is the same as the curing agent 2.

11. The racket frame according to claim 3, wherein a fiber contained in the layer (L1) is the same as a fiber contained in the layer (L2).

12. The racket frame according to claim 1, wherein the rubber component is a core shell polymer having a core part and a shell part; and a polymer constituting the core part is insoluble in an epoxy resin.

13. The racket frame according to claim 1, wherein the rubber component is a core shell polymer having a core part and a shell part; and a polymer constituting the core part is the following polymer (Pa), polymer (Pb), or polymer (Pc):

(Pa) a polymer obtained by polymerizing a monomer containing 50% by weight or greater of one or more monomers selected from the group consisting of a conjugated diene monomer and a (meth)acrylic ester monomer;

(Pb) polysiloxane rubber; and (Pc) a mixture of the polymer (Pa) and the polymer (Pb).

14. The racket frame according to claim 13, wherein a weight of the polymer (Pa) to a weight of the whole core part is equal to or greater than 50% by weight.

15. The racket frame according to claim 1, wherein the rubber component is a core shell polymer having a core part and a shell part; and a principal component of the core part is a polymer obtained by copolymerizing one or more vinyl monomers and the conjugated diene monomer and/or the (meth)acrylic ester monomer.

16. The racket frame according to claim 1, wherein the rubber component is a core shell polymer having a core part and a shell part; and a polyfunctional monomer is used as a raw material polymer of the core part.

17. The racket frame according to claim 1, wherein the rubber component is a core shell polymer having a core part and a shell part; and 70% by weight or greater of a polymer constituting the shell part is bonded to a polymer constituting the core part.

18. The racket frame according to claim 1, wherein the rubber component is a core shell polymer having a core part and a shell part; and a polymer constituting the shell part is a polymer obtained by polymerizing one or more monomers selected from a (meth) acrylic ester, an aromatic vinyl compound, and a vinyl cyanide compound.

19. The racket frame according to claim 18, wherein in addition to the monomer, one or more monomers selected from the group consisting of (meth)acrylic esters having a reactive side chain such as alkyl (meth)acrylate, hydroxyalkyl (meth)acrylate, and epoxyalkyl (meth)acrylate; epoxy alkyl vinyl ether; (meth)acryl amide (which includes an N-substitute); α,β-unsaturated acid; α,β-unsaturated acid anhydride and a maleimide derivative are copolymered.

20. The racket frame according to claim 1, wherein the rubber component is a core shell polymer having a core part and a shell part; and a ratio [a mass of the core part/a mass of the shell part] is 50/50 or greater and 95/5 or less.

* * * * *